United States Patent [19]

Gibson

[11] 4,203,591

[45] May 20, 1980

[54] ARM, WRIST AND SHOULDER FRICTION TYPE EXERCISING DEVICE

[75] Inventor: Stan Gibson, Richmond, Canada

[73] Assignee: Graphic Holdings, Ltd., Surrey, Canada

[21] Appl. No.: 849,222

[22] Filed: Nov. 7, 1977

[51] Int. Cl.[2] ..... A63B 5/00

[52] U.S. Cl. ..... 272/67; 272/132; 272/DIG. 4

[58] Field of Search ..... 272/67, 68, 131, 132, 272/DIG. 4, DIG. 3

[56] References Cited

U.S. PATENT DOCUMENTS

| | | | |
|---|---|---|---|
| 2,668,055 | 2/1954 | Sharp et al. | 272/68 |
| 3,184,234 | 5/1965 | Struble | 272/131 X |
| 3,211,453 | 10/1965 | Williams | 272/131 X |
| 3,717,338 | 2/1973 | Hughes | 272/67 |
| 3,764,131 | 10/1973 | Rooks | 272/68 X |
| 3,830,493 | 8/1974 | Miller | 272/67 |

*Primary Examiner*—Richard C. Pinkham
*Assistant Examiner*—William R. Browne

[57] ABSTRACT

An arm, wrist and shoulder exercising device includes a pair of elongated spindles connected to each other through an angularly adjustable locking member. A hand grip is rotatably mounted about each spindle and a frictional clutch is provided with may be adjusted to vary the force required to rotate each hand grip with respect to the spindle. The locking member includes a disc at one end of each spindle, and the discs are secured to each other by a threaded fastener extending through the centers of the discs. Radial teeth extending from the centers of the discs interlock to prevent rotation of the discs with respect to each other in order to fix the angle between the hand grips. The longitudinal axes of the spindles substantially intersect at the threaded fastener.

7 Claims, 6 Drawing Figures

FIG. 1
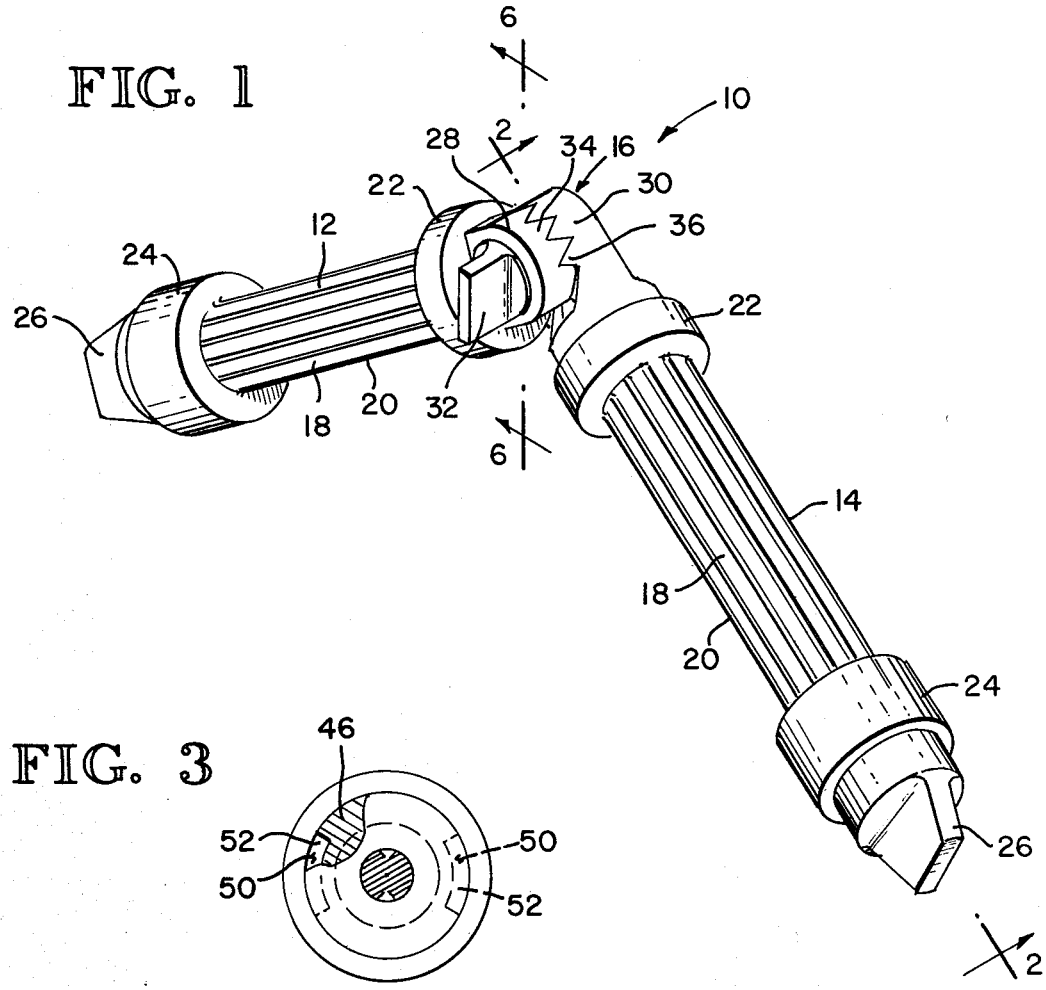
FIG. 3
FIG. 2
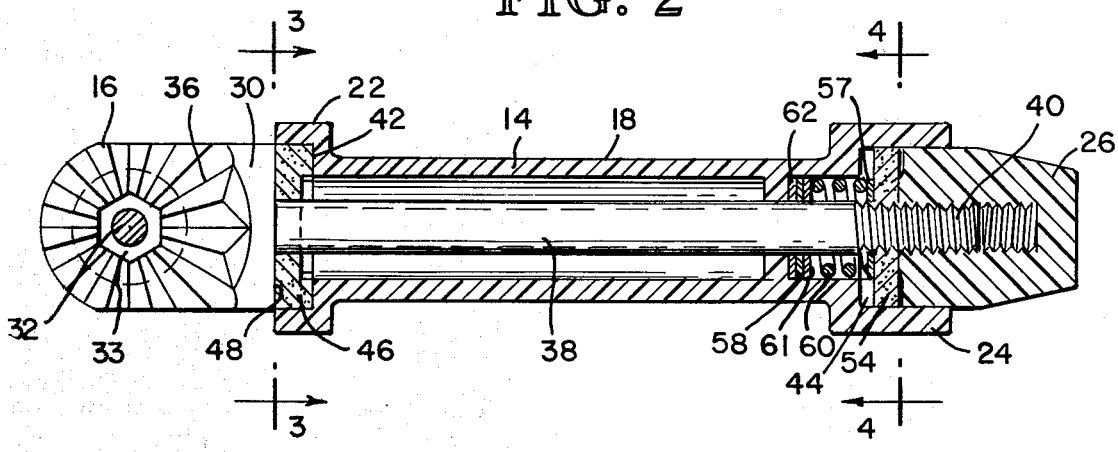

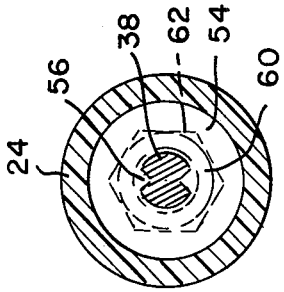
FIG. 4
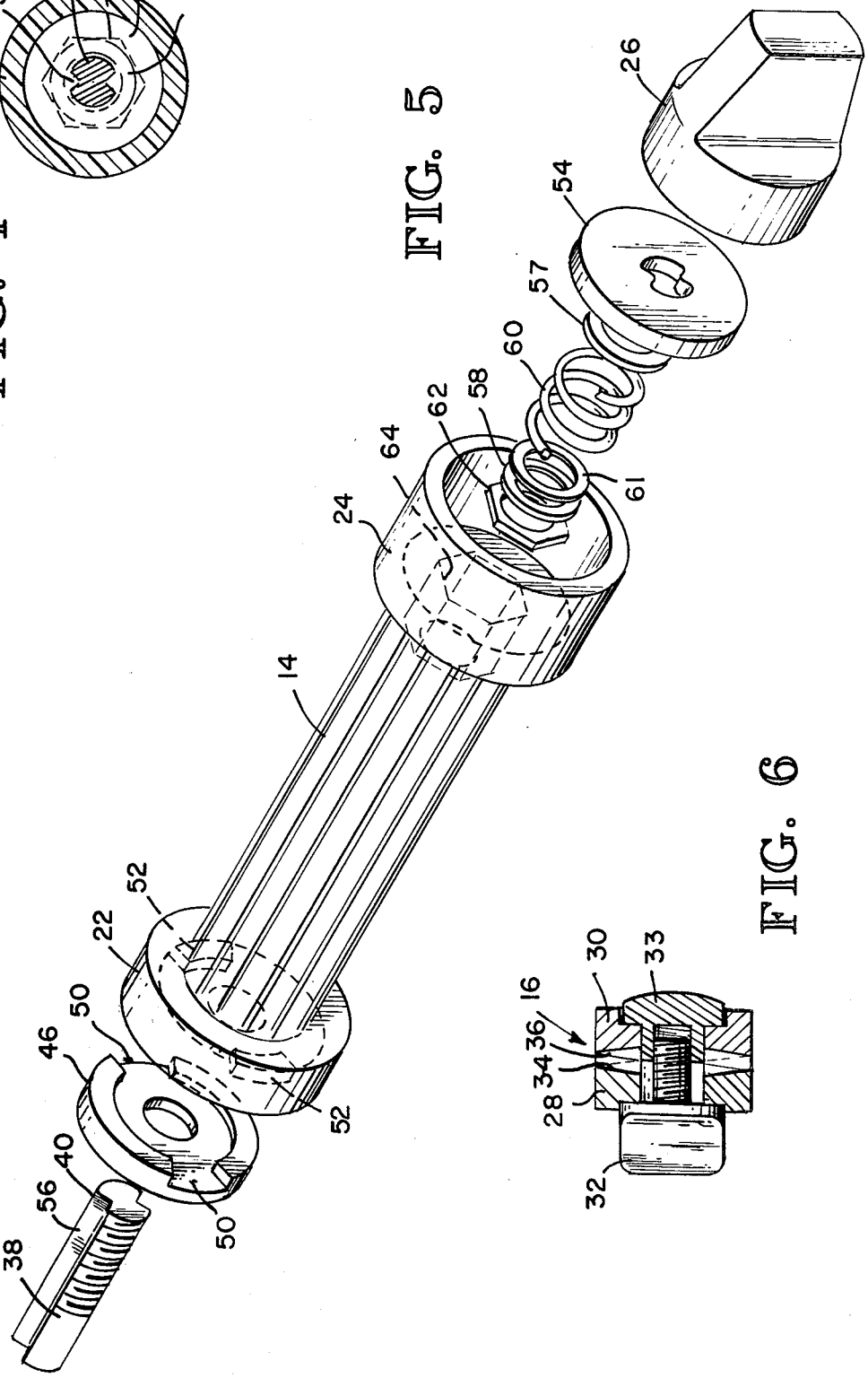
FIG. 5
FIG. 6

ARM, WRIST AND SHOULDER FRICTION TYPE EXERCISING DEVICE

BACKGROUND OF THE INVENTION

1. Field of the Invention

This invention relates to exercising devices, and more particularly to an exercising device for allowing simultaneous arm, wrist and shoulder exercise.

2. Description of the Prior Art

Devices for exercising the arms, wrists or shoulders of an individual are well known and in common use. Examples of devices which exercise the wrists of an individual are illustrated in U.S. Pat. Nos. 3,330,558 issued to Simons, Jr. and 3,084,547 issued to Nielsen. These devices utilize a pair of aligned hand grips which are forcibly twisted with respect to each other. However, since forces are exerted on the hand grips in essentially a single direction, relatively few of the muscles associated with the wrist are exercised.

Examples of devices for principally exercising arms and shoulders of an individual are illustrated in U.S. Pat. Nos. 3,516,661 issued to Hansen and 3,343,837 issued to Grzybowski. In the Hansen device a pair of hand grips are connected to each other through a bar and are moved in a crank-like fashion. In the Grzybowski device a pair of hand grips are moved toward and away from each other.

The principal problem with these devices is that they generally only exercise either the wrists or arms of an individual, but not both simultaneously. Furthermore, the forces transmitted to the exercising devices are principally in a single direction so that a relatively few muscles are exercised.

SUMMARY OF THE INVENTION

It is an object of the invention to provide an exercising device which simultaneously produces arm, wrist and shoulder exercise.

It is another object of the invention to provide an exercising device which receives forces in a multitude of directions thereby maximizing the number of muscles being exercised.

These and other objects of the invention are achieved by a pair of hand grips connected to each other at one end by an adjustable fastener so that the angle of the hand grips with respect to each other may be adjusted. The hand grips are adapted to rotate about their axes, and an adjustable clutch is utilized to selectively vary the force required to rotate the hand grips. The hand grips are preferably mounted about respective elongated spindles with a generally circular plate of frictional braking material positioned at the inner end of each hand grip and adapted to engage a shoulder formed adjacent the end of the spindle. The exercising device is utilized by grasping the hand grip between a pair of shoulders formed at opposite ends of the hand grip. The exercising device is utilized by grasping the hand grips and simultaneously rolling the wrists in the same direction so that the junction of the two hand grips continuously revolves in a circular path having horizontal, transverse axis. This rolling action simultaneously exercises the wrists, arms and shoulders of an individual, and the widely varying direction of the forces exerted on the hand grips exercises a relatively large number of muscles.

BRIEF DESCRIPTION OF THE DRAWINGS

FIG. 1 is an isometric view of the exercising device.

FIG. 2 is a cross-sectional view taken along the line 2—2 of FIG. 1.

FIG. 3 is a cross-sectional view taken along the line 3—3 of FIG. 2.

FIG. 4 is a cross-sectional view taken along the line 4—4 of FIG. 2.

FIG. 5 is an exploded isometric view of one portion of the exercising device.

FIG. 6 is a cross-sectional view taken along the line 6—6 of FIG. 1.

DETAILED DESCRIPTION OF THE PREFERRED EMBODIMENTS

As illustrated in FIG. 1, the exercising device 10 includes a pair of hand grips 12, 14 interconnected to each other at one end by an adjustable connector means 16. The hand grips 12, 14 include a cylindrical portion 18 having elongated ribs 20 formed on their outer surfaces and shoulders 22, 24 at the inner and outer ends, respectively. As explained hereinafter, the hand grips 12, 14 are adapted to rotate independently with respect to the connector means 16. The torque required to rotate the hand grips 12, 14 is controlled by rotating a compression adjusting screw 26 positioned adjacent the outer shoulder 24.

As illustrated further in FIGS. 1 and 6, the adjustable connector means 16 includes disc-like members 28, 30. The disc-like members 28, 30 are secured to each other by an adjustment screw 32 extending through the hexagonal passages in the discs 28, 30 to engage the threads of a nut 33. The outer surface of the nut 33 is also hexagonal to prevent it from rotating in hexagonal passage of disc 30. The length of the nut 33 is less than the thickness of the disc 30 so that the nut does not extend into the disc 28 and thereby prevent relative rotation of the discs when desired to change their angular ralationship. A plurality of radial teeth 34, 36 formed on the adjacent faces of the discs 28, 30, respectively, mesh with each other to fix the angle between the hand grips 12, 14 is adjusted by rotating adjusting screw 32 counterclockwise to allow the discs 28, 30 to move apart from each other, and then rotating the discs 28, 30 with respect to each other before rotating the adjusting screw 32 clockwise to securely fasten the discs 28, 30 to each other.

The internal structure of the exercising device, including the mounting means for the hand grips, 12, 14, is best illustrated in FIGS. 2 and 5. The hand grip 14 is coaxially mounted about an elongated spindle 38 having the fastening disc 30 formed at its inner end and being threaded at its outer end 40. Both ends of the hand grip 14 are formed with cylindrical recesses 42, 44. A circular plate of frictional braking material 46 is positioned between the face of the recess 42 at the inner end of the hand grip 14 and a flat surface 48 integrally formed on the disc 30. As best illustrated in FIGS. 3 and 5, the circular plate 46 contains a pair of arcuate cutouts 50 which receive arcuate projections 52 extending outwardly in the recesses 42 in order to cause the plate 46 of braking material to rotate with the hand grip 14.

The opposite end of the hand grip 14 also contains a circular plate 54 which, as best illustrated in FIGS. 4 and 5, is keyed to a notch 56 formed on the threaded end 40 of the spindle 38. The plate is positioned between a washer 57 and the adjusting screw 26. The plate 54 positions the spindle 38 coaxial with the hand grip 14.

The washer 57 is urged against the inner face of the plate 54 by a compression spring 60. The inner end of the compression spring bears against a metal washer 61 which abuts a fiber washer 58 which in turn bears against a hexagonal washer 62. The hexagonal washer 62 fits into a hexagonal recess 64 formed in the outer end of the handle 14. Thus the washer 62 rotates with the hand grip 14, and the plate 54 and the adjusting screw 26 remain stationary on the spindle 38. The force exerted on the plate 46 may be adjusted by rotating adjusting screw 26 to vary the compression on spring 60.

In use, the angle between the hand grips 12, 14 is first adjusted as desired. As the hand grips 12, 14 are moved a greater angle out of alignment the degree to which the wrist must be rolled in order to produce continuous rotation of the device increases so that smaller angles between the hand grips 12, 14 require more effort but also provides greater exercise of the wrists, arms and shoulders. The adjusting screws 26 are then rotated to provide the desired degree of friction between the hand grips 12, 14 and the friction surfaces 48 of the discs 28 and 30. The structure of the hand grip 12 is substantially identical to hand grip 14.

I claim:

1. An arm, wrist and shoulder exercising device, comprising a pair of tubular hand grips, each of said hand grips being coaxially mounted about respective, elongated spindles which are connected to each other by adjustable coupling means for selectively varying the angle between said spindles, said clutch means including the point of substantial intersection of the extension of the axes of the spindles said device further including hand grip mounting means for allowing said hand grips to rotate with respect to each other, said mounting means further including adjustable clutch means for selectively varying the force required to rotate said hand grips with respect to said hand grip mounting means.

2. The exercising device of claim 1 wherein said adjustable coupling means comprise respective disc-like members formed at the adjoining ends of said spindles, said disc-like members being releasably secured to each other face-to-face along a common axis such that the angle between said hand grips may be adjusted by rotating said disc-like members with respect to each other.

3. The exercising device of claim 2 wherein radial teeth formed on the adjacent faces of said disc-like members extend outwardly from the centers of said members, the teeth of one member meshing with the teeth of the other member to fix the angle between said hand grips at one of a plurality of discrete values.

4. The exercising device of claim 1 wherein said adjustable clutch means comprises a generally circular sheet of frictional braking material at the inner end of said hand grip between said hand grip and a shoulder formed on the inner end of said spindle, said clutch means further including adjustment means for varying the compressive forces on said frictional braking material to adjust the force required to rotate said hand grips.

5. An arm, wrist and shoulder exercising device, comprising:

a pair of elongated spindles each having inner and outer ends, said spindles having their inner ends connected to each other through respective disc-like members placed face-to-face with each other about a common axis which substantially engages and is perpendicular to the axes of said spindles, said spindles having an externally threaded outer end;

a threaded fastener means extending through the center of said disc-like members to adjustably vary the angle between the axes of said spindles;

a cylindrical hand grip coaxially mounted about each of said spindles;

a cylindrical sheet of frictional braking material positioned between the planar inner face of each hand grip and respective planar shoulders formed at the inner ends of said spindles adjacent said disc-like members;

a torque adjustment screw threaded onto the outer end of each spindle;

a cylindrical positioning disc mounted on the outer end of each spindle positioned between the outer end of each hand grip and the inner face of the respective adjustment screws; and a compression spring extending between the end of each hand grip and the cylindrical positioning disc such that rotation of said adjustment screws varies the compression on said spring and the force applied to said frictional braking material to adjust the torque required to rotate said hand grips.

6. The exercising device of claim 5 wherein the sheet of frictional braking material at the inner ends of said hand grips contain a pair of diametrically spaced arcuate slots receiving arcuate projections from the inner ends of said hand grips so that the inner ends of said hand grips rotate with said hand grips.

7. The exercising device of claim 5 wherein the outer end of each spindle contains a pair of diametrically spaced longitudinal slots, said slots receiving retaining fingers projecting inwardly from the center of the cylindrical positioning disc at the outer ends of said spindle such that the position disc at the outer ends of said spindles remain stationary with respect to said spindles and the rotation of said adjusting screws.

* * * * *